US006974053B2

(12) United States Patent
Lautre et al.

(10) Patent No.: US 6,974,053 B2
(45) Date of Patent: Dec. 13, 2005

(54) STERILE SYSTEM FOR DISPENSING A PRODUCT CONTAINED IN A CONTAINER IN PARTICULAR A SOFT TUBE

(75) Inventors: Philippe Lautre, Oyonnax (FR); Pascal Hennemann, Vaux les Saint Claude (FR)

(73) Assignee: Plastohm S.A., (FR)

( * ) Notice: Subject to any disclaimer, the term of this patent is extended or adjusted under 35 U.S.C. 154(b) by 0 days.

(21) Appl. No.: 10/496,612

(22) PCT Filed: Nov. 29, 2002

(86) PCT No.: PCT/FR02/04106

§ 371 (c)(1),
(2), (4) Date: May 25, 2004

(87) PCT Pub. No.: WO03/050010

PCT Pub. Date: Jun. 19, 2003

(65) Prior Publication Data

US 2005/0067440 A1 Mar. 31, 2005

(30) Foreign Application Priority Data

Dec. 13, 2001 (FR) ..... 01 16333

(51) Int. Cl.[7] ..... B65D 47/28

(52) U.S. Cl. ..... 222/92; 222/212; 222/493

(58) Field of Search ..... 222/92, 107, 212, 222/492, 493, 495, 496, 521, 525

(56) References Cited

U.S. PATENT DOCUMENTS

| | | | | | |
|---|---|---|---|---|---|
| 1,911,616 | A | * | 5/1933 | Gruber | 222/492 |
| 1,928,895 | A | * | 10/1933 | Jensen | 222/493 |
| 1,948,070 | A | * | 2/1934 | Hasse et al. | 222/493 |
| 1,971,371 | A | * | 8/1934 | Donnelly | 222/493 |
| 2,628,004 | A | * | 2/1953 | Schlicksupp | 222/493 |
| 2,711,271 | A | * | 6/1955 | Schlicksupp | 222/493 |
| 3,076,583 | A | * | 2/1963 | Eberspacher | 222/493 |
| 3,134,517 | A | * | 5/1964 | Seybold | 222/493 |
| 4,141,474 | A | * | 2/1979 | Nilson | 222/493 |
| 5,692,651 | A | * | 12/1997 | Fuchs | 222/494 |
| 5,918,854 | A | * | 7/1999 | Barrash et al. | 251/116 |

* cited by examiner

*Primary Examiner*—Kenneth Bomberg
(74) *Attorney, Agent, or Firm*—Bachman & LaPointe, P.C.

(57) ABSTRACT

The invention concerns a dispensing and closure system arranged at the top of a container, in particular a soft tube comprising a liquid or pasty product, which is delivered by pressing on the tube. The invention is characterized in that it consists of a valve comprising two concentric elements, one of which forms a mobile cylindrical delivery valve and the other forms a cylindrical body exiting from a plate linked to the tube. The two elements defined between them an annular gap through which the product passes. When a manual pressure is exerted on the tube, it causes the product to act directly on the delivery valve causing the latter to open, countering an elastic return member, so as to allow the product to escape from the tube, when the pressure is exerted thereon and to automatically close the delivery valve when the pressure is released, preventing the possible return of the product already dispensed from returning inside the tube.

14 Claims, 5 Drawing Sheets

STERILE SYSTEM FOR DISPENSING A PRODUCT CONTAINED IN A CONTAINER IN PARTICULAR A SOFT TUBE

BACKGROUND OF THE INVENTION

The present invention relates to a dispensing and closure system arranged at the end of a container, in particular a soft tube containing a liquid or pasty product which is delivered by pressing on said tube.

In certain fields, such as cosmetology or dermatology, it is essential to preserve the sterility of the product contained in the tube or bottle.

Therefore, it is known to introduce an antibacterial preservative into the product, be this a liquid or pasty product, such as, for example, creams, gels or emulsions.

This makes it possible to prevent bacterial product degradation, which would risk affecting the appearance, quality or smell of said product, hence the incorporation of a preservative into the product's chemical composition.

Nevertheless, these preservatives sometimes give rise to dermatological allergies.

It is known to solve this second problem by not using such preservatives and by protecting the product through the use of "airless" dispensing systems.

An airless system involves a pump mounted on a container whose volume can vary by means of a piston or a pouch actuated by the difference in pressure as the material is dispensed by the pump.

However, such devices are very complex as they require the use of a large number of pieces, i.e. approximately ten, that have to be produced and assembled.

Also known are systems using membranes that can deform elastically upon closure of an end piece, but these have the drawback of leaktightness being achieved by means of adjusting the elasticity of the material and the dimensions of the opening.

Furthermore, there is the problem of the residual product forming a dead volume in the dispensing head, this residue no longer being protected against bacteria.

To remedy this problem, end closures are known such as valves fitted on pump dispenser end pieces for pharmaceutical or cosmetological applications.

It is also known, in order to boost antibacterial protection, to mix, with the plastic forming the package and, more particularly, the dispensing head, silver ions that have the special feature of not migrating and of destroying bacteria by contact with said plastic surface charged with silver ions.

In such a case, the antibacterial action comes into play only upon close contact with the surface of the container, and not at the core.

In fact, the present invention proposes to remedy all these drawbacks, i.e. at the level of the (airless) pump, in terms of the head-protection mechanism.

SUMMARY OF THE INVENTION

To this end, the invention relates to a dispensing and closure system arranged at the end of an elastically deformable container, in particular a soft tube comprising a liquid or pasty product, which is delivered by pressing on said tube, which consists of a valve comprising two concentric elements, one of which forms a mobile cylindrical delivery valve that includes, in its central upper part, an opening defining a peripheral seat, and the other of which forms a cylindrical body emanating from a plate linked to the tube, and in which the closed top of said cylindrical body is able to interact, upon closure, with the seat of said mobile delivery valve, the two elements defining between them an annular gap through which the product passes, at the time of a manual pressure exerted on the tube, causing, as a consequence, the product to act directly on the delivery valve causing the latter to open, countering an elastic return member, so as to allow the product to escape from the tube, when the pressure is exerted thereon and to automatically close the opening when the pressure is relaxed, with no possible return of the product 10 that has already exited toward the inside.

The present invention also relates to the characteristics that will become apparent during the following description and that should be considered in isolation or in all their possible technical combinations.

BRIEF DESCRIPTION OF THE DRAWINGS

This description, given by way of non-limiting example, will make it easier to understand how the invention may be implemented, with reference to the appended drawings, in which.

DETAILED DESCRIPTION OF THE PREFERRED EMBODIMENT(S)

Figure 1:
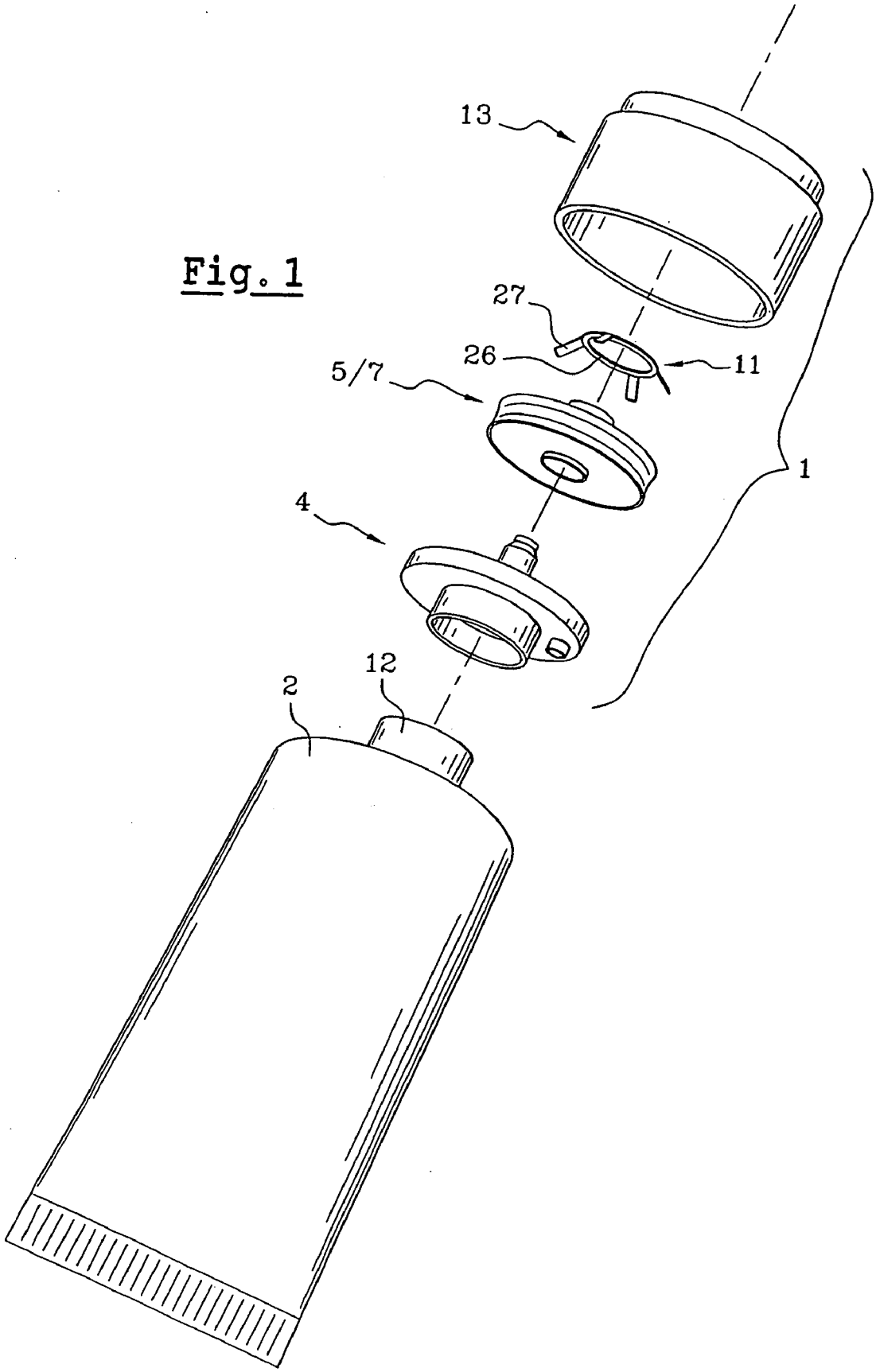
FIG. 1 is an exploded perspective view of a dispensing system according to the invention fitted onto a soft tube.
Figure 2:
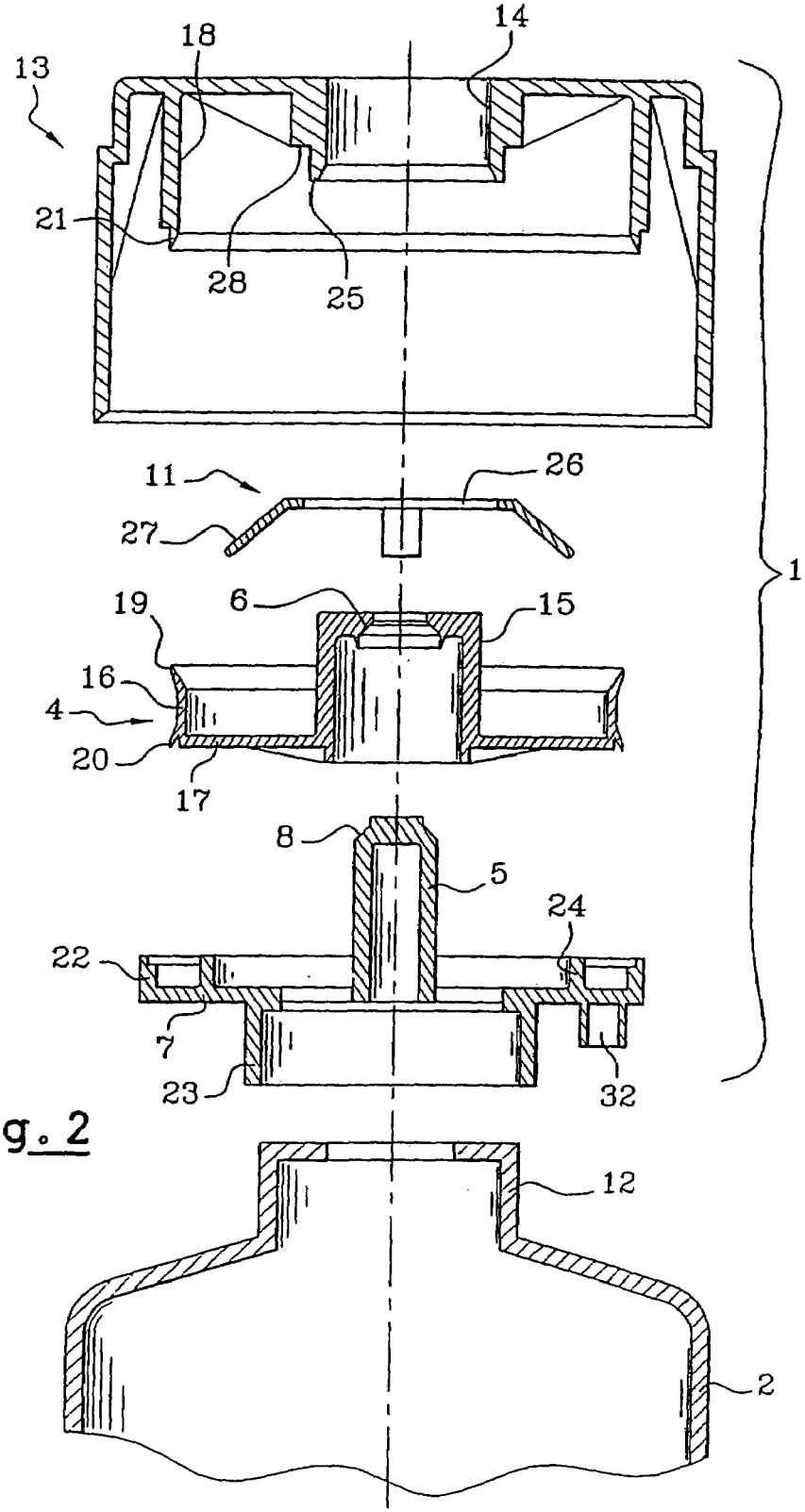
FIG. 2 is an exploded plan view according to FIG. 1.

The dispensing system 1, denoted overall in the figures, is arranged at the end of a container 2, in this case a flexible bottle or tube containing a pasty product which is delivered by pressing on said tube 2.

According to the invention, the system 1 consists of a valve 3 comprising two concentric elements 4, 5. One 4 of them forms a mobile cylindrical delivery valve that includes, in its central upper part, an opening 6 defining a peripheral seat. The other 5 forms a cylindrical body 6 emanating from a plate 7 linked to the tube 2, the closed top 8 of said cylindrical body 5 being able to interact, upon closure, with the seat 6 of said mobile delivery valve 4 by means of two sealing zones 29 and 31. The two elements 4, 5 define between them an annular gap 9 through which the product 10 passes when a manual pressure F1, F2 is exerted on the tube 2, causing, as a consequence, the product 10 to act directly on the delivery valve 4 causing the latter to open, countering an elastic return member 11. In this way, the delivery valve 4 allows the product 10 to escape from the tube 2 when the pressure F1, F2 is exerted thereon and automatically closes the opening 6 when the pressure is relaxed, with no possible return of the product 10 that has already exited toward the inside.

It should be noted that the opening 6 forming the seat of the mobile delivery valve 4 is frustoconical according to the present illustrative embodiment, but it could, of course, be formed by a spherical part or a part with any other, conical or cylindrical, form.

As clearly shown in the figures, the mobile cylindrical delivery valve 4 is mounted so as to slide in an axial direction between the body 5 of the linking plate 7 which is integral with the end 12 of the tube 2 and a cylindrical cap 13 capping said system, also integral with the tube 2. Said cap 13 includes, in its upper part, a first cylindrical outer bore 14 that is open at its two ends, in which a first cylindrical part 15 of the delivery valve 4 is guided and can slide when it opens or closes.

Also, the mobile delivery valve 4 includes a second cylindrical guide part 16, concentric with the first 15, produced at the periphery of a bottom collar 17 extending from a lower zone of the first cylindrical part 15 of said delivery valve 4 and coming into contact with a second internal bore 18 of the cap 13, which is open only at its lower part.

Figure 3:
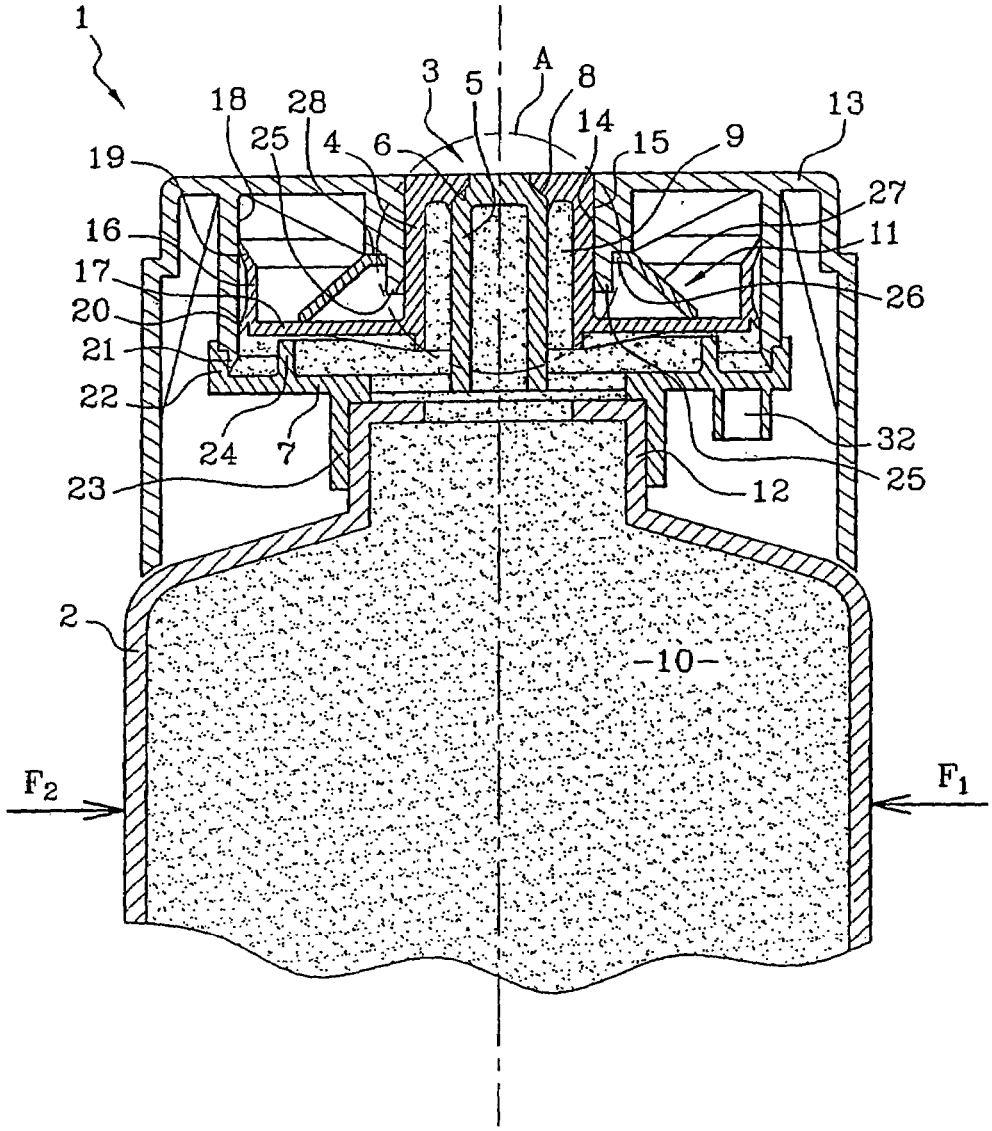
FIG. 3 is a view of the system according to FIGS. 1 and 2 after assembly in the closed position.
Figure 4:
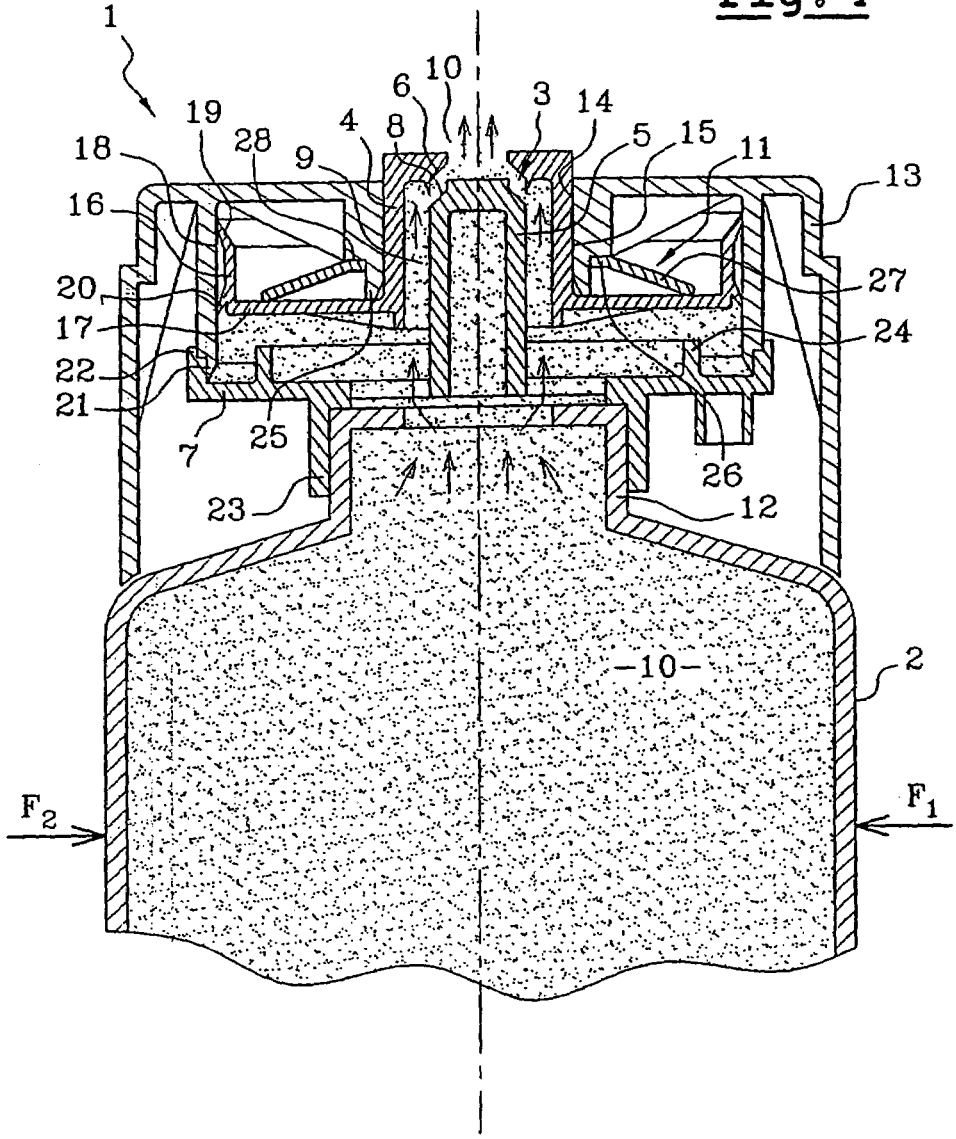
FIG. 4 is a view of the system according to FIGS. 1 and 2 after assembly in the open position.

As FIGS. 3 and 4 show, the second cylindrical guide part 16 of the mobile delivery valve 4 includes an upper lip 19 and a lower lip 20 in frictional contact on the second bore 18 of the cap 13, with a view to guaranteeing leaktightness when said delivery valve 4 functions from the open position to the closed position, and vice versa.

According to another characteristic of the invention, the wall of the cap 13 defining the second inner bore 18 of the cap extends at its lower part in order to form a peripheral end edge 21 interacting in a fixed manner with a raised edge 22 of the linking plate 7. The latter is formed by a collar extending from an upper zone of a cylindrical sleeve 23 emanating from said plate 7 at its lower part, which sleeve 23 interacts in a fixed manner with the top 12 of the tube 2 that it caps.

In fact, the system 1 coupled to the tube 2 must constitute a whole that cannot be dismantled, in order to preserve sterility and the desired seal.

Furthermore, the linking plate 7 includes a second raised edge 24 produced concentrically between the first peripheral raised edge 22 and the fixed cylindrical body 5 of said linking plate 7 so as to form a lower stop for the mobile delivery valve 4 acting upon closure. A lower end part 25 of the first bore 14 of the cap 13 forms an upper stop for said delivery valve 4, acting upon closure.

According to another characteristic of the invention, the elastic return member 11 for the mobile delivery valve 4 is interposed between an inner part of the delivery valve and an inner part of the fixed cap 13.

According to the present illustrative embodiment, the elastic return member 11 consists of a washer 26 from which emanates a plurality of radial arms 27 spaced angularly in an identical manner. Said washer 26 is arranged in a fixed manner on an inner shoulder 28 of the cap 13, while the arms 27 bear on the bottom collar 7 of the mobile delivery valve 4 so as to return the latter automatically to the closure position after opening.

Of course, although not shown, the elastic return member 11 may be formed of a plurality of radial arms 27 spaced angularly at identical angles and obtained by molding with an inner part of the cap 13, the arms 27 bearing on the bottom collar 17 of the mobile delivery valve 4 so as to return the latter automatically to the closure position after opening.

Whatever the case may be, the elastic return member may have different forms and consist of different materials, but it must be able to fulfill a spring function.

Figure 5:
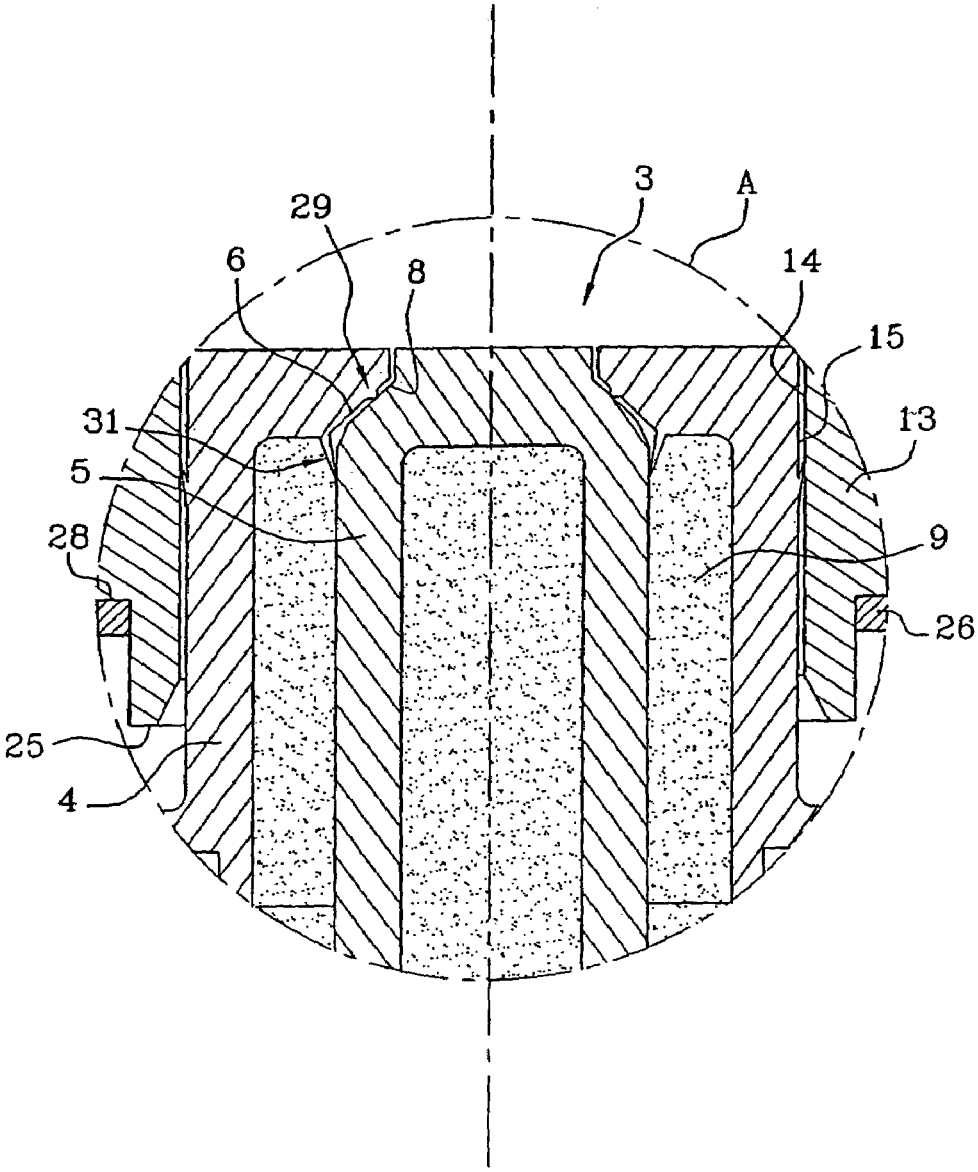
FIG. 5 is a view of detail A on an enlarged scale.

According to another characteristic of the invention, particularly clearly visible in FIG. 5, a double seal is obtained in the opening/closure zone of the valve 3 by means of the combination of a first peripheral lip 29, produced on the seat 6 of the mobile delivery valve 4, so as to exert an axial action on a corresponding zone of the end 8 of the cylindrical body 5 of the linking plate 7 and a second lip 31, which is also peripheral, produced, also, starting from the seat 6 of the mobile delivery valve 4, at a distance from the first 29, so as to exert a radial action on an axial part of said cylindrical body 5 of the linking plate 7.

In fact, the lips 29 and 31 form a double closure, and thus each one is offset in terms of time such that, upon closure, the residue of material located between the two lips is expelled outward.

According to another characteristic of the invention, the system comprises an air-intake device consisting of an end piece 32 produced at the lower part of the linking plate 7 and inside which a porous antibacterial filter is arranged (not shown).

This air intake makes it possible to give the tube back its initial shape and to improve the emptying rate without introducing bacteria.

The porous filter on the one hand allows an intake of air from outside the cap toward the intermediate zone located between the linking plate 7 and the delivery valve 4 containing the material 10, hence toward the inside of the tube, and on the other hand prevents bacteria from the outside from penetrating toward the inside and allows the escape of the product 10 from the inside toward the outside.

Although not shown, the system may include a closure cover, an inner bearing zone of which comes into compressive contact with the top of the valve 3, in order to lock the opening.

This cover, which may be articulated or screwed into the closure position, also makes it possible, by virtue of its bearing zone, to prevent an inappropriate translational movement of the delivery valve 4, which could give rise to an exit of product 10.

Preferably, the mobile delivery valve 4, the linking plate 7, the cap 13, the elastic member 11, the tube 2, and the cover (not shown) are obtained by molding from plastic.

As regards the elastic member 11, this will preferably be obtained by molding a polypropylene with glass fibers or a polyacetal, or any other material with mechanical characteristics suitable for guaranteeing the spring function.

As regards the tube 2, this is produced in a conventional manner from a plastic that gives it characteristics of flexibility through permanent or elastic deformation.

For the reasons stated above, all the pieces of the dispensing system, namely the mobile delivery valve 4, the linking plate 7, the cap 13, the elastic member 11, and the cover (not shown) are obtained from plastic containing silver ions.

This makes it possible to guarantee an absence of bacterial proliferation on the residual film of material.

The system just described can be sterilized using gamma and beta radiation.

It should also be noted that this is a non-deformable, mechanical system actuated simply by means of the pressure the user applies to the tube, which is itself elastically or non-elastically deformable.

This system, formed of only four, or even three, pieces, provides antibacterial end opening and closure, functioning in the manner of a non-return delivery valve, opening on account of the thrust of the product on the piston, countering the elastic member 11, and having the effect of clearing the opening by creating a peripheral passage after a vertical translational movement of the delivery valve 4.

Furthermore, dead volumes are no longer possible as the valve 3 closes again automatically as soon as the pressure F1, F2 on the tube 2 is relaxed.

At that point, as stated above, the time offset between the two closures consisting of the lips 29 and 31 makes it possible to expel the residue of material located between said lips toward the outside.

In sum, total product sterility is obtained because:

there is no return of material;

there is no intake of air or, if air intake is provided for, the use of a porous antibacterial filter prevents bacteria from entering;

there is a mechanical double seal;

provision is made for bacteriostatic protection at certain locations using silver ions incorporated into the plastic.

What is claimed is:

1. A dispensing and closure system arranged at an end of a container formed by a soft tube containing a liquid or pasty product which is delivered by pressing on said tube, said system comprising a valve comprising two concentric elements, a first one of said concentric elements forming a mobile cylindrical delivery valve that includes, in its central upper part, an opening defining a peripheral seat, and a second one of said concentric elements forming a cylindrical body emanating from a plate linked to the tube, a closed top of said cylindrical body being able to interact, upon closure, with the seat of said mobile delivery valve, the two concentric elements defining between them an annular gap through which the product passes, at the time of a manual pressure exerted on the tube, causing, as a consequence, the product to act directly on the delivery valve causing the delivery valve to open, countering an elastic return member, and a double seal obtained in the opening/closure zone of the valve by means of the combination of a first peripheral lip and a second lip, which is also peripheral, produced at a distance from the first lip such that said lips form a double closure so that, upon closure, the residue of material located between the two lips is expelled outward, with no possible return of the product that has already exited toward the inside.

2. The system as claimed in claim 1, wherein the first peripheral lip is produced on the seat of the mobile plate so as to exert an axial action on a corresponding zone of the end of the cylindrical body of the linking plate, wherein the second lip, which is also peripheral, is produced, also, starting from the seat of the delivery valve so as to exert a radial action on an axial part of said cylindrical body of the linking plate, and wherein each of said lips is offset in terms of time.

3. The system as claimed in claim 1, wherein the mobile cylindrical delivery valve is mounted so as to slide in an axial direction between the body of the linking plate which is integral with the end of the tube and a cylindrical cap capping said system, also integral with the tube, said cap including, in its upper part, a first cylindrical outer bore that is open at its two ends, in which a first cylindrical part of the delivery valve is guided and can slide when the valve opens or closes.

4. The system as claimed in claim 3, wherein the mobile delivery valve includes a second cylindrical guide part, concentric with the first cylindrical part, produced at the periphery of a bottom collar extending from a lower zone of the first cylindrical part of said delivery valve and coming into contact with a second internal bore of the cap, which is open only at its lower part.

5. The system as claimed in claim 4, wherein the second cylindrical guide part of the mobile delivery valve includes an upper lip and a lower lip in frictional contact on the second bore of the cap, with a view to guaranteeing leak-tightness when said delivery valve functions.

6. The system as claimed in claim 4, wherein the wall of the cap defining the second inner bore of the cap extends at its lower part in order to form a peripheral end edge interacting in a fixed manner with a raised edge of the linking plate, the latter being formed by a collar extending from an upper zone of a cylindrical sleeve emanating from said plate at its lower part, which sleeve interacts in a fixed manner with the top of the tube that it caps.

7. The system as claimed in claim 6, wherein the linking plate includes a second raised edge produced concentrically between the first peripheral raised edge and the fixed cylindrical body of said linking plate so as to form a lower stop for the mobile delivery valve acting upon closure, a lower end part of the first bore of the cap forming an upper stop for said delivery valve acting upon closure.

8. The system as claimed in claim 1, which includes an elastic return member for the mobile delivery valve, interposed between an inner part of the delivery valve and an inner part of the fixed cap.

9. The system as claimed in claim 8, wherein the elastic return member consists of a washer from which emanates a plurality of radial arms spaced angularly in an identical manner, said washer being arranged in a fixed manner on an inner shoulder of the cap, while the radial arms bear on the bottom collar of the mobile delivery valve so as to return the delivery valve automatically to the closure position after opening.

10. The system as claimed in claim 8, wherein the elastic return member consists of a plurality of radial arms spaced angularly at identical angles and obtained by molding with an inner part of the cap, the radial arms bearing on the bottom collar of the mobile delivery valve so as to return the latter automatically to the closure position after opening.

11. The system as claimed in claim 1, which comprises an air-intake device consisting of an end piece produced at a lower part of the linking plate and inside which a porous antibacterial filter is arranged.

12. The system as claimed in claim 1, which includes a closure cover, an inner bearing zone which comes into compressive contact with the top of the valve in order to lock the opening.

13. The system as claimed in claim 1, wherein the mobile delivery valve, the linking plate, the cap, the elastic member, the tube, and the cover are obtained by molding from plastic.

14. The system as claimed in claim 13, wherein the mobile delivery valve, the linking plate, the cap, the elastic member, and the cover are formed from plastic containing silver ions.

* * * * *